US007168116B2

(12) United States Patent
Reger et al.

(10) Patent No.: US 7,168,116 B2
(45) Date of Patent: Jan. 30, 2007

(54) PATIENT SUPPORT APPARATUS HAVING AN AIR CELL GRID AND ASSOCIATED METHOD

(75) Inventors: Steven I. Reger, Cleveland, OH (US); Richard R. Navarro, Hinckley, OH (US)

(73) Assignee: The Cleveland Clinic Foundation, Cleveland, OH (US)

( * ) Notice: Subject to any disclaimer, the term of this patent is extended or adjusted under 35 U.S.C. 154(b) by 0 days.

(21) Appl. No.: 10/839,002

(22) Filed: May 5, 2004

(65) Prior Publication Data

US 2004/0226103 A1 Nov. 18, 2004

Related U.S. Application Data

(60) Provisional application No. 60/467,860, filed on May 5, 2003.

(51) Int. Cl.
*A47C 27/10* (2006.01)
*A61G 13/12* (2006.01)

(52) U.S. Cl. ..... 5/713; 5/702; 5/913

(58) Field of Classification Search ..... 5/713, 5/710, 655.4, 702, 910, 911, 600, 913
See application file for complete search history.

(56) References Cited

U.S. PATENT DOCUMENTS 4,989,283 A 2/1991 Krouskop
5,253,656 A 10/1993 Rincoe et al.
5,279,010 A 1/1994 Ferrand et al.
5,449,002 A 9/1995 Goldman
5,560,057 A 10/1996 Madsen et al.
5,560,374 A 10/1996 Viard
5,596,781 A 1/1997 Graebe
5,794,289 A 8/1998 Wortman et al.
5,815,864 A 10/1998 Sloop
5,966,763 A 10/1999 Thomas et al.
6,094,762 A 8/2000 Viard et al.
6,154,907 A 12/2000 Cinquin
6,385,803 B1 5/2002 Viard
6,598,251 B2 7/2003 Habboub et al.

*Primary Examiner*—Alexander Grosz
(74) *Attorney, Agent, or Firm*—Tarolli, Sundheim, Covell & Tummino LLP

(57) ABSTRACT

An apparatus (10) for supporting a patient during a medical procedure includes a bead bag (18) that is filled with compressible beads (20) and that forms a lower layer of the apparatus (10). The apparatus (10) also includes a layer of foam material (30) that is located above the bead bag and an air cell grid (36) that has a plurality of inflatable air cells (38). The air cell grid (36) forms an upper layer of the apparatus (10) and provides a soft surface upon which the patient lies. The bead bag (18), when subjected to a vacuum, becomes rigid for supporting the air cell grid (36) against the patient for helping to maximize a surface area of contact between the patient and the apparatus (10).

10 Claims, 6 Drawing Sheets

PATIENT SUPPORT APPARATUS HAVING AN AIR CELL GRID AND ASSOCIATED METHOD

This application claims priority of U.S. Provisional Application No. 60/467,860, filed on May, 5, 2003.

TECHNICAL FIELD

The present invention relates to an apparatus for supporting a patient during a medical procedure and to a method of using the apparatus to support a patient. More particularly, the present invention relates to a surgical support surface for supporting a patient during a surgical procedure and to a method of use for the surgical support surface.

BACKGROUND OF THE INVENTION

A surgical support surface supports a patient on a surgical table. A typical surgical support surface includes a foam rubber interior and a plastic cover. When a patient lies on the typical surgical support surface, the pressure interface between the patient and the surgical support surface is concentrated at particular locations on the patient's body, such as at the patient's heals, sacrum, scapulas, and cranium. Pressure ulcers may occur at locations of high interface pressure between the patient and the surgical support surface. Additionally, when the surgical table is moved or tilted, areas of high interface pressure are subject to shear. It is desirable to minimize areas of high interface pressure between the patient and the surgical support surface and to prevent the occurrence of shear during movement of the surgical table.

U.S. Pat. No. 5,966,763 attempts to address the problem of high interface pressure between the patient and a surface pad. A vacuum bead bag is placed in the surface pad at a location for engaging the patient. The vacuum bead bag conforms to the contour of the patient to increase the surface area of contact between the patient and the surface pad. Once the vacuum bead bag conforms to the contour of the patient, the vacuum bead bag is rigidified for supporting the patient during the medical procedure.

In addition to minimizing areas of high interface pressure between the patient and the surgical support surface and preventing the occurrence of shear, it is also desirable for a surgical support surface to be radiolucent. Radiolucency of the surgical support surface enables x-rays of a patient to be taken while the patient is located on the surgical support surface.

SUMMARY OF THE INVENTION

The present invention relates to an apparatus for supporting a patient during a medical procedure. The apparatus comprises a bead bag that is filled with compressible beads. The bead bag forms a lower layer of the apparatus. The apparatus also comprises a layer of foam material that is located above the bead bag and an air cell grid that has a plurality of inflatable air cells. The air cell grid forms an upper layer of the apparatus and provides a soft surface upon which the patient lies. The bead bag, when subjected to a vacuum, becomes rigid for supporting the air cell grid against the patient for helping to maximize a surface area of contact between the patient and the apparatus.

According to another aspect, the present invention relates to an apparatus for supporting a patient during a medical procedure. The apparatus comprises an air cell grid having a plurality of inflatable air cells. Each air cell includes a base wall and an upper wall. The upper wall moves away from the base wall when the air cell is inflated into an expanded condition. The apparatus also comprises an electrical switch for indicating a collapsed condition of an associated air cell of the air cell grid. The electrical switch includes a first electrical contact that is located on the base wall of the associated air cell and a second electrical contact that is located on the upper wall of the associated air cell. The first and second electrical contacts come into engagement with one another in response to the associated air cell moving into the collapsed condition.

According to yet another aspect, the present invention relates to a method of supporting a patient on a support structure having an air cell grid that includes a plurality of inflatable air cells. In accordance with the inventive method, the air cells of the air cell grid are inflated into an expanded condition. The air cells of the air cell grid are vented to atmosphere while maintaining the air cells in the expanded condition. Air cells of the air cell grid are isolated from one another and from atmosphere. The patient is positioned on the support structure above the air cell grid. The air cells are then placed in fluid communication with one another to equalize air pressure throughout the air cell grid for helping to equalize an interface pressure between the patient and the support structure.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF EMBODIMENTS

Figure 1:
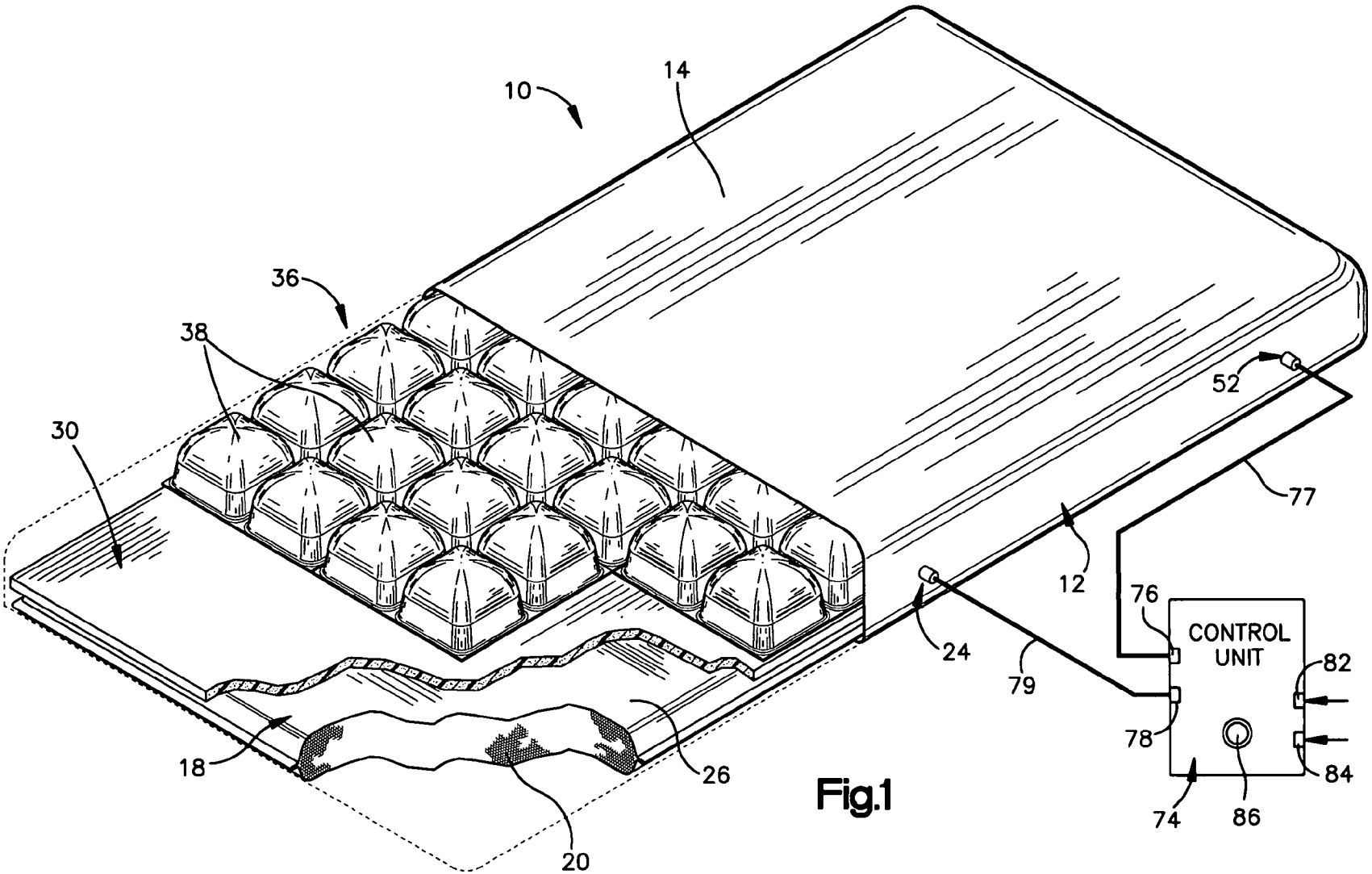
FIG. 1 is a perspective cutaway view of an apparatus constructed in accordance with the present invention.

FIG. 1 is a perspective cutaway view of an apparatus 10 constructed in accordance with the present invention. The apparatus 10 is a surgical support surface for supporting a patient (not shown) during a surgical procedure. Alternatively, the apparatus 10 may be used for supporting a patient during a medical procedure other than surgery. For example, the apparatus 10 may be used in an emergency vehicle, such as an ambulance, in which medical procedures are performed on a patient while transporting the patient to a medical facility.

The apparatus 10 illustrated in FIG. 1 is to be positioned on a surgical table (not shown) below a patient. The apparatus 10 includes a pliable elastic cover 12 that defines an upper surface 14 and a lower surface (not shown) of the apparatus 10. The lower surface of the apparatus 10 lies on the surgical table and the upper surface 14 of the apparatus supports the patient. The apparatus 10 functions to maximize the surface area of contact between the patient and the upper surface 14 so as to minimize areas of high interface pressure between the patient and the apparatus. Additionally, the apparatus 10 provides stability for retaining the patient in position during movement of the surgical table so as to minimize the occurrence of shear on the patient.

As shown in FIG. 1, the apparatus 10 includes a bead bag 18. The bead bag 18 is a pliable plastic bag in which is stored a plurality of compressible beads 20. A valve 24, shown schematically in FIG. 1, extends through the bead bag 18 for allowing airflow into and out of the bead bag. FIG. 1 illustrated the valve 24 extending outwardly through the cover 12 of the apparatus 10. When subjected to a vacuum, the bead bag 18 stiffens, i.e., becomes more rigid. Under a partial vacuum, the bead bag 18 becomes moldable and has a stiffness sufficient to remain in its molded condition. The bead bag 18 becomes rigid when the vacuum is increased. When rigid, the bead bag 18 is no longer moldable.

The bead bag 18 forms a lower layer of the apparatus 10. Only the portion of the cover 12 that defines the lower surface of the apparatus 10 extends between the bead bag 18 and the surgical table. The bead bag 18 has a length and a width that are substantially equal to a length and width of the apparatus 10. In one embodiment, the bead bag 18 has a width of approximately three feet and a length of approximately seven feet. A depth of the bead bag 18, measured vertically between a lower surface (not shown) of the bead bag and an upper surface 26 of the bead bag when the bead bag is at atmospheric pressure, i.e., in a non-molded condition, is approximately one and a half to two inches. It should be understood that the dimensions of the bead bag 18 might be varied depending upon the intended use of the apparatus 10. Also, the dimensions of the bead bag 18 may vary as a result of molding of the bead bag during use.

A layer of highly resilient foam material 30 overlies the upper surface 26 of the bead bag 18. The layer of foam material 30 preferably is formed from polyurethane. The layer of foam material 30 has a length and a width that are substantially equal to the length and width of the bead bag 18 and, in one embodiment of the invention, has a depth that is approximately three-quarters of an inch.

An air cell grid 36 overlies the layer of foam material 30. The air cell grid 36 includes a plurality of air cells 38. All of the air cells 38 of the air cell grid 36 may be interconnected with one another with a separate valve (not shown) associated with each air cell. In an exemplary embodiment of the apparatus 10, the air cells 38 are formed in groups with the groups of air cells being interconnected, as is described below.

Figure 2:
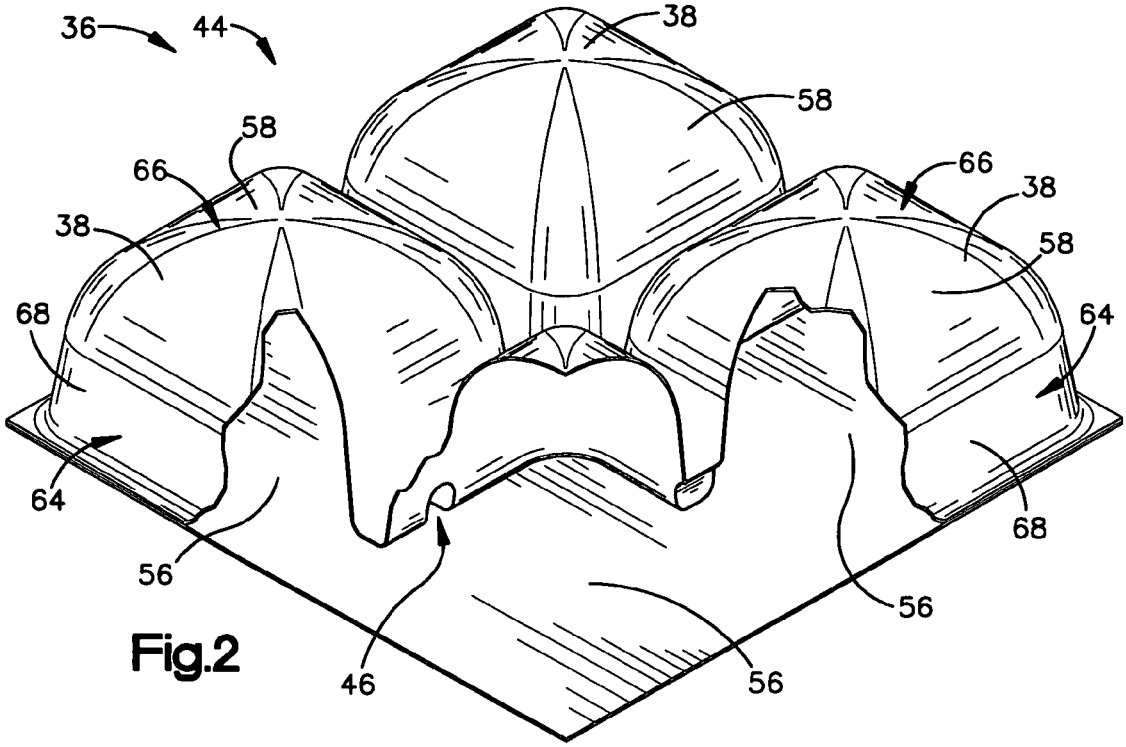
FIG. 2 is a perspective cutaway view of a group of air cells of an air cell grid of the apparatus of FIG. 1.
Figure 3:
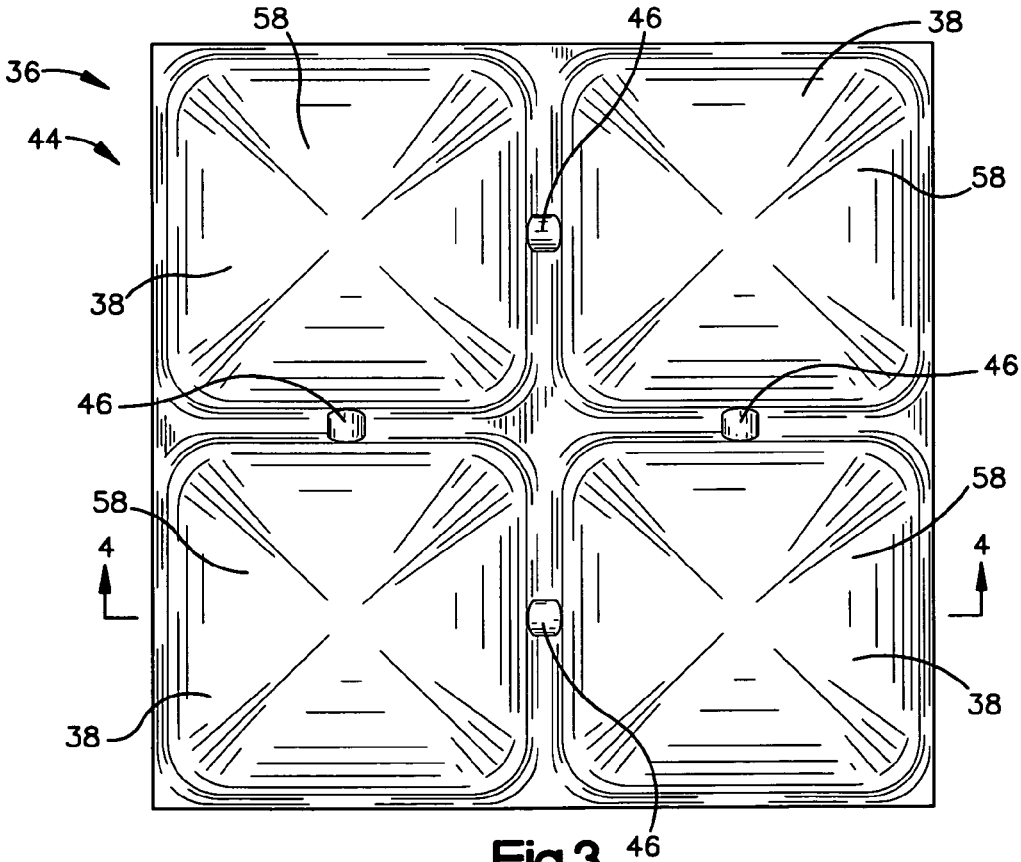
FIG. 3 is a top view of the group of air cells of FIG. 2.

FIG. 2 is a perspective cutaway view illustrating an exemplary group 44 of air cells 38. The group 44 illustrated in FIG. 2 includes four air cells 38. The air cells 38 in the group 44 are formed in a two-by-two array. The group 44 of air cells 38 preferably is molded from vinyl. The vinyl enables each air cell 38 of the group 44 to be inflated into an expanded condition but prevents ballooning of the air cells. As shown in FIG. 3, the group 44 also includes four molded air channels 46. The molded air channels 46 are disposed between laterally adjacent air cells 38 and longitudinally adjacent air cells of the group 44.

A valve 48 (FIG. 4) is associated with the group 44 of air cells 38. The valve 48 has open and closed conditions. In the open condition, air may flow through the valve 48 and into or out of the air cells 38 of the group 44. In the closed condition, air is prevented from entering or exiting the group 44 of air cells 38. Thus, the valve 48, when in the open condition, may be used for interconnecting the group 44 of air cells 38 with other groups of air cells in the air cell grid 36 and, when in the closed condition, may be used for isolating the group 44 of air cells 38 from other groups of air cells in the air cell grid 36.

With reference again to FIG. 1, groups of air cells 38 are arranged laterally and longitudinally adjacent to one another to completely cover the length and width of the layer of foam material 30. The valves of the groups of air cells 38, such as valve 48 of group 44, are interconnected with one another. Preferably, conduits (not shown) located within the apparatus 10 and under the air cell grid 36 interconnect the valves. An air valve 52 (FIG. 1) also connects to the conduits for enabling airflow into and out of the air cell grid 36. FIG. 1 illustrates the air valve 52 extending outwardly from the cover 12. Alternatively, each group of air cells 38 of the air cell grid 36 may include a conduit that extends outside of the cover 12 of the apparatus 10 and valves for interconnecting the groups of air cells may be located outside of the cover 12.

Figure 4:
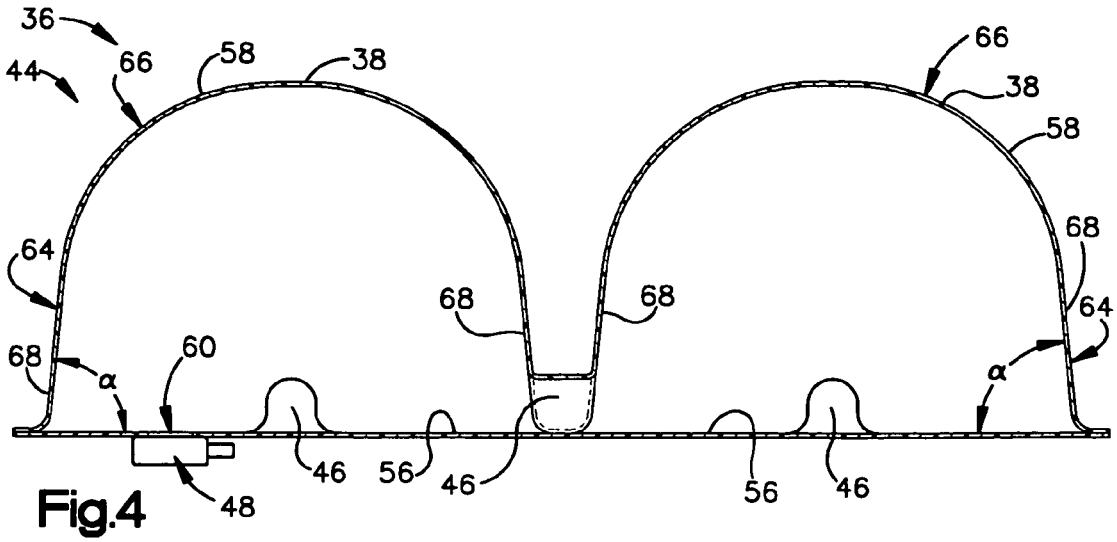
FIG. 4 is a view taken along line 4—4 in FIG. 3.

As shown in FIG. 4, each air cell 38 of the air cell grid 36 includes a base wall 56 and an upper wall 58. A common sheet of material may form the base walls 56 of all of the air cell 38 of the group 44. The upper wall 58 of each air cell 38 is affixed to the base wall 56. Preferably, the upper wall 58 of each air cell 38 is molded to its associated base wall 56.

The base wall 56 of each air cell 38 is substantially planar and has a generally square configuration. An air channel 60 extends through a base wall 56 of one of the air cells 38 in the group 44. The air channel 60 is in fluid communication with the valve 48 and enables airflow into and out of the air cells 38 of the group 44.

The air cells 38 each have a fully expanded condition. The air cells 38 are illustrated in FIGS. 2–4 in the fully expanded condition. When in the fully expanded condition, each air cell 38 has a height of approximately two and a half inches.

When an air cell 38 is in the fully expanded condition, the upper wall 58 includes a generally square base portion 64 and a domed upper portion 66. The base portion 64 (FIG. 2) includes four sidewalls 68. FIG. 4 only illustrates two of the sidewalls 68 of each air cell 38. Each sidewall 68 extends upwardly from the base wall 56 at an acute angle relative to the base wall 56. FIG. 4 illustrates the angle between the sidewall 68 and the base wall 56 as angle $\alpha$. Preferably, angle $\alpha$ is approximately 85 degrees. However, it will be understood by those skilled in the art that the angle $\alpha$ may be different based on the material used and its thickness. The sidewalls 68 extend upwardly from the base wall 56 for approximately one-half of the height of the air cell 38. The domed upper portion 66 of the air cell 38 connects the four sidewalls 68. When the air cell 38 is in the fully expanded condition, the domed upper portion 66 of the air cell 38 is located at its farthest distance away from the base wall 56.

The relative angle between the base wall 56 and the sidewall 68 helps with the radiolucency of the apparatus 10. When the air cell grid 36 of the apparatus 10 is loaded with the weight of the patient, it is unlikely that a large portion of any of the sidewalls 68 of the air cells 38 will extend in a direction perpendicular to an upper surface of the surgical table. An x-ray is usually taken at an angle perpendicular to the upper surface of the surgical table. Since it is unlikely that a large portion of any of the sidewalls 68 of the air cells 38 will extend in the direction of the x-ray, resistance to the x-ray passing through the air cell grid 36 is minimized. As a result, the apparatus 10 provides sufficient radiolucency for allowing x-rays of a patient positioned on the apparatus.

The cover 12 of the apparatus 10 completely surrounds the bead bag 18, the layer of foam material 30, and the air cell grid 36. The cover 12 is preferably made from a material that is easily cleaned and that is non-absorptive.

As shown schematically in FIG. 1, the apparatus 10 also includes a control unit 74. The control unit 74 may be battery operated or may include an electrical cord for receiving electrical power. Alternatively, the control unit 74 and its associated compressor may be manually operated to either compress air or to pull a vacuum. The control unit 74 includes an air outlet port 76 and a vacuum inlet port 78. Conduit 77 connects the air outlet port 76 of the control unit 74 to the valve 52. Conduit 79 connects the vacuum inlet port 76 of the control unit 74 to the valve 24. The control unit 74 also includes an air inlet port 82 for connection to a compressed air source (not shown) and a vacuum outlet port 84 for connection to a vacuum source (not shown). Alternatively, the control unit 74 may include a pump (not shown). The air outlet port 76 and the vacuum inlet port 78 may be connected to the pump for providing compressed air and vacuum, respectively.

Figure 5:
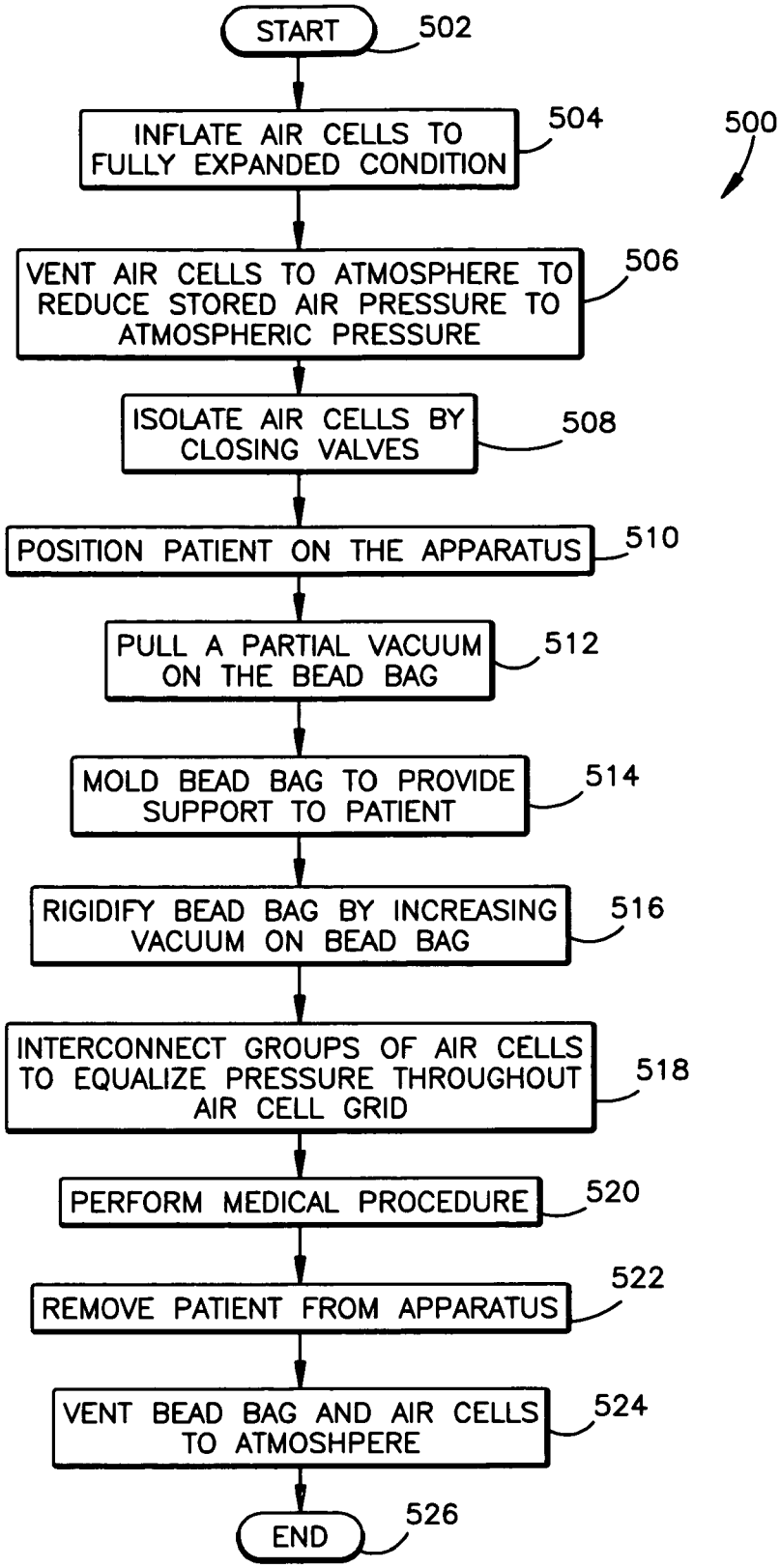
FIG. 5 is a flow diagram illustrating a method in accordance with the present invention.

The control unit 74 also includes a control knob 86 that is rotated for performing particular steps associated with the use of the apparatus 10. By way of example, FIG. 5 illustrates a process 500 for using the apparatus 10 for supporting a patient during a medical procedure. Various steps of the process 500 may be associated with rotational positions of the control knob 86.

The process 500 of FIG. 5 begins at step 502 at which the control unit 74 is powered on. At step 504, the air cells 38 of the air cell grid 36 are inflated into a fully expanded condition. To inflate the air cells 38 to the fully inflated condition, the control unit 74 controls the supply of compressed air into the air cell grid 36. The valve associated with each group of air cells 38, such as valve 48 of group 44, is opened to allow the air pressure within each air cell to increase. The increased air pressure within the air cells 38 expands the air cells into the fully expanded condition. From step 504 the process 500 proceeds to step 506.

At step 506, the air cells 38 of the air cell grid 36 are vented to atmosphere. To vent the air cells 38 to atmosphere, the valve associated with each group of air cells 38 remains in the open condition and the valve 52 is connected to atmosphere. When the air cells 38 are vented to atmosphere, the air pressure within each air cell substantially equalizes with the atmospheric air pressure. Since, at this time, no forces other than atmospheric pressure are being applied to the air cells 38, the air cells remain in the fully expanded condition.

At step 508, the valve associated with each group of air cells 38 is closed so that the groups of air cells are isolated from one another. When isolated from one another, the air cells 38 within each group, such as the air cells of group 44, remain in fluid communication with one another through the air channels 46. From step 508 the process 500 proceeds to step 510 at which the patient is positioned on the apparatus 10. The patient may be positioned in any position on the apparatus 10. Generally, for surgical procedures, the patient is either in a supine position or in a side-lying position.

At step 512, a partial vacuum is pulled on the bead bag 18. When subjected to the partial vacuum, the bead bag 18 becomes moldable and remains in its molded position. At step 514, the medical personnel mold the bead bag 18 to provide support to areas of the patient that are commonly subject to low interface pressure, such as the lumbar region of the spine when the patient is in the supine position, the perineum, and the lateral aspects of the thorax and the thighs. After the bead bag 18 is molded at step 514, the bead bag 18 is rigidified at step 516. To rigidify the bead bag 18, the vacuum on the bead bag 18 is increased. The process 500 proceeds from step 516 to step 518.

At step 518, the groups of air cells 38 are interconnected, i.e., placed in fluid communication with one another, so that the air pressure throughout the air cell grid 36 equalizes. To interconnect the groups of air cells 38, the valve associated with each group of air cells 38 is placed in the open condition and the valve 52 remains in the closed condition. When the valve of each group of air cells 38 is opened, the air pressure throughout the air cell grid 36 will equalize. Ideally, when the groups of air cells 38 are interconnected to equalize the air pressure throughout the air cell grid 36, the distance between the patient and the molded and rigidified bead bag 18 will be relatively constant over the entire area of contact between the patient and the apparatus 10.

When the air pressure throughout the air cell grid 36 is equalized, the surface area of contact between the upper surface 14 of the apparatus 10 and the patient is maximized. As a result, areas of high interface pressure between the patient and the apparatus 10 are minimized.

At step 520, the medical procedure is performed. The medical procedure may involve moving or tilting of the surgical table. The apparatus 10 of the present invention minimizes movement of the patient during the movement of the surgical table. Also, the use of the layer of foam material 30 between the generally soft air cell grid 38 and the rigidified bead bag 18 helps reduce shear on the patient. The layer of foam material 30 also provides a baseline level of support for the patient should a failure occur to the air cell grid 36.

After the medical procedure is performed, the patient is removed from the apparatus 10 at step 522. At step 524, the valves 24 and 52 of the apparatus 10 are opened and the bead bag 18 and the air cell grid 36 are vented to atmosphere. When the bead bag 18 is vented to atmosphere, the bead bag 18 becomes soft and returns to its original non-molded condition. After the bead bag 18 and the air cell grid 36 are vented to atmosphere, the process 500 ends at step 526.

To prevent areas of high interface pressure between the patient and the apparatus 10, it is desirable to ensure that each air cell 38 of the air cell grid 36 remains at least partially expanded while the patient is being supported on the apparatus 10. When an air cell 38 "bottoms out," i.e., collapses so that the upper wall 58 and the base wall 56 of the air cell 38 come into contact with one another, an area of high interface pressure between the patient and the apparatus 10 may occur. To help prevent the bottoming out of air cells 38, some or all of the air cells 38 of the air cell grid 36 may be constructed to include an integral electrical switch for indicating a bottoming out or collapsed condition of the air cells.

Figure 6:
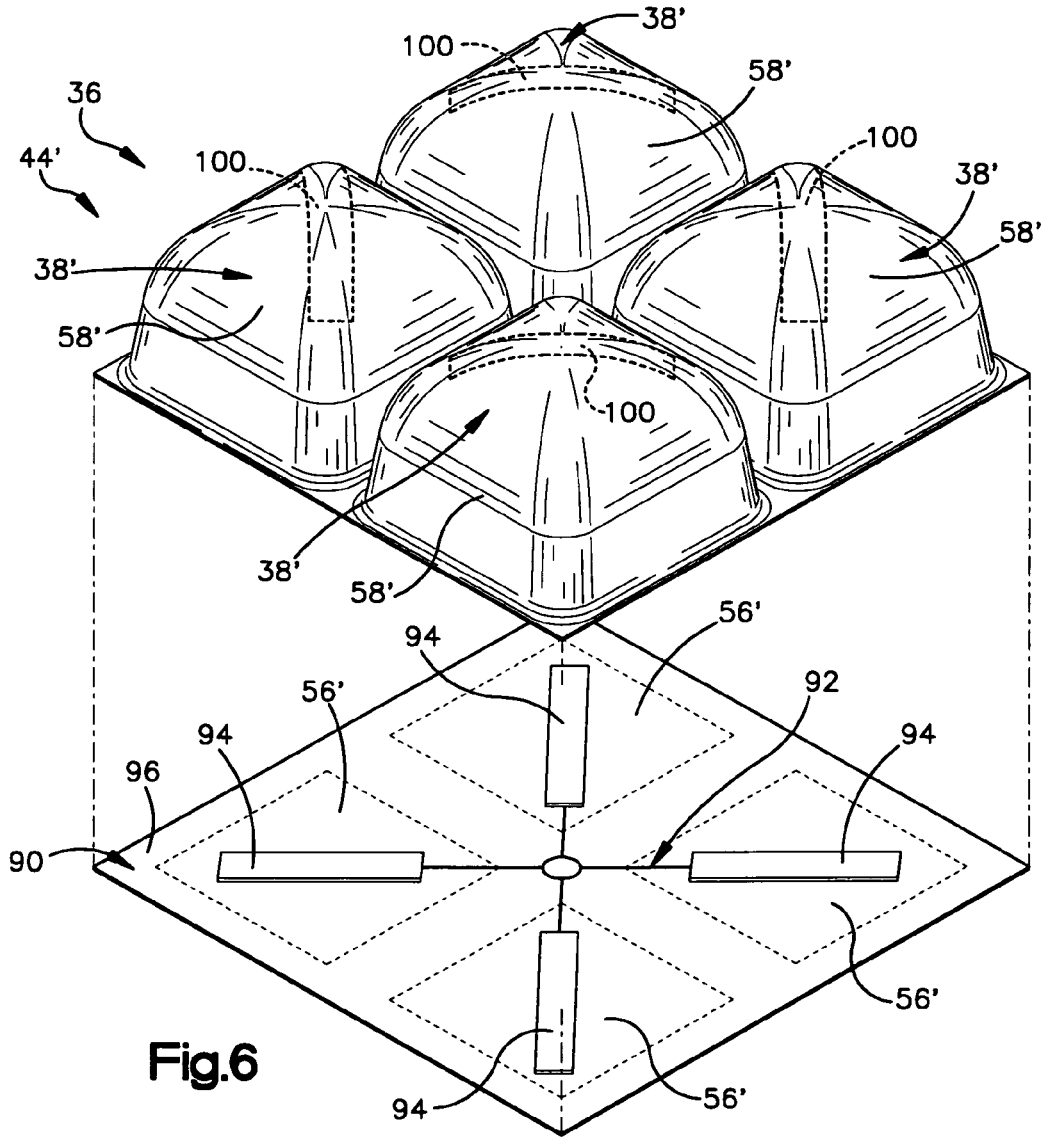
FIG. 6 is an exploded perspective view of a group of air cells constructed in accordance with an alternative embodiment of the present invention.

FIG. 6 is an exploded perspective view of a group 44' of air cells 38' constructed in accordance with an alternative embodiment of the present invention. The group 44' of air cells 38' of FIG. 6 may be used in the apparatus 10 illustrated in FIG. 1.

The base walls 56' of the air cells 38' of the group 44' are formed from a single sheet 90 of material. A first electrically conductive grid 92 is located on an upper surface 96 of the sheet 90. The first electrically conductive grid 92 that is illustrated in FIG. 6 includes four electrical contact 94. One electrical contact 94 is associated with the base wall 56' of each air cell 38' of the group 44'. The first electrically conductive grid preferably is screen-printed on the sheet 90.

A second electrically conductive grid (not shown) is also associated with the upper walls 58' of the air cells 38' of the group 44'. The second electrically conductive grid preferably is screen-printed on the sheet upper walls 58'. FIG. 6 illustrates an electrical contact 100 of the second electrically conductive grid located on an interior surface of each upper wall 58' of the group 44'. The electrical contact 100 on the upper wall 58' of each air cell 38' extends generally perpendicularly to the electrical contact 94 on the base walls 56' of the air cell so that a bottoming out of any portion of the air cell will cause the electrical contacts 94 and 100 to engage one another.

The electrical contacts 94 and 100 are electrically coupled to the control unit 74 (FIG. 1). When the electrical contacts 94 and 100 come together, i.e., engage one another, an electrical signals is sent to the control unit 74 indicating that an air cell 38' has bottomed out. The control unit 74 may include an alarm for indicating to the medical personnel performing the medical procedure that an air cell 38' has bottomed out. Additionally, or alternatively, the control unit 74 may include an automatic inflation mode that is responsive to the electrical signal indicative of a bottomed out condition for controlling the supply of compressed air and the valve 52 of the apparatus 10 for providing air into the air cell grid 36 to inflate the air cells 38'. When the electrical contacts 94 and 100 disengage as a result of inflation of the bottomed out air cell 38', the control unit 74 discontinues inflation of the air cell grid 36 and closes the valve 52 associated with the air cell grid.

Figure 7:
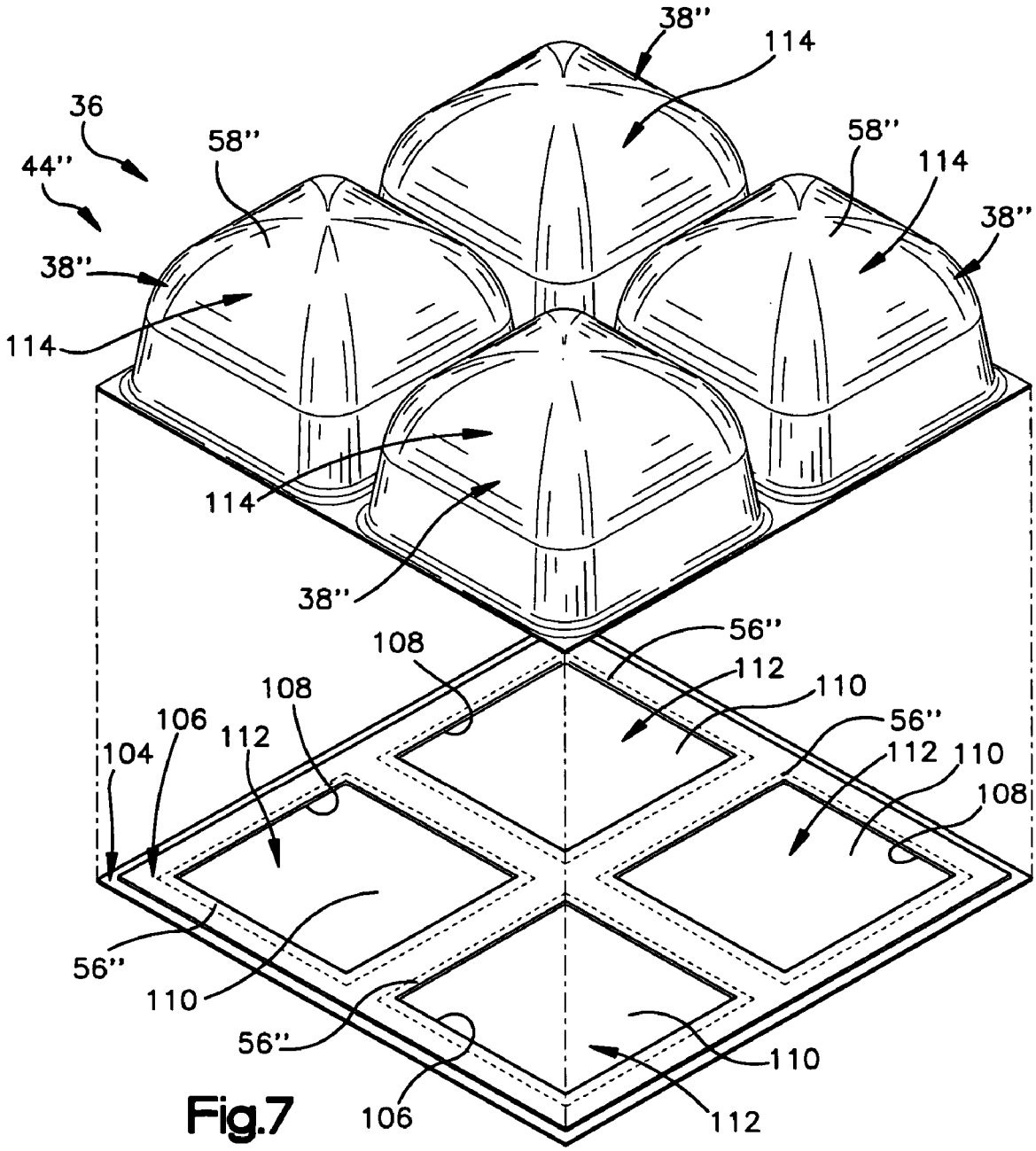
FIG. 7 is an exploded perspective view of a group of air cells constructed in accordance with a second alternative embodiment of the present invention.

FIG. 7 is an exploded perspective view of a group 44" of air cells 38" constructed in accordance with a second alternative embodiment of the present invention. The group 44" of air cells 38" of FIG. 7 may be used in the apparatus 10 illustrated in FIG. 1.

The base walls 56" of the air cells 38" of the group 44" are formed from two sheets of material. A lowermost layer 104 is formed from an electrically conductive material. In one embodiment of the invention, the lowermost layer 104 is formed from an electrically conductive vinyl. An insulating layer 106 overlies the lowermost layer 104. The insulating layer 106 is electrically non-conductive. A plurality of cutouts 108 extends through the insulating layer 106. A cutout 108 is associated with the base wall 56" of each air cell 38" of the air cell grid 36. Each cutout 108 in the insulating layer 106 is square and extends over a large portion of the base wall 56" of the associated air cell 38". The portion 110 of the lowermost layer 104 that is open through an associated cutout 108 at the base wall 56" of each cell forms an electrical contact 112.

The upper wall 58" of each air cell 38" is formed from an electrically conductive material. In one embodiment of the invention, the upper wall 58" is formed from an electrically conductive vinyl. The upper wall 58" also forms an electrical contact 114.

The electrical contacts 112 and 114 are electrically coupled to the control unit 74 (FIG. 1). When the electrical contacts 112 and 114 come together, an electrical signals is sent to the control unit 74 indicating that an air cell 38" has bottomed out.

Figure 8:
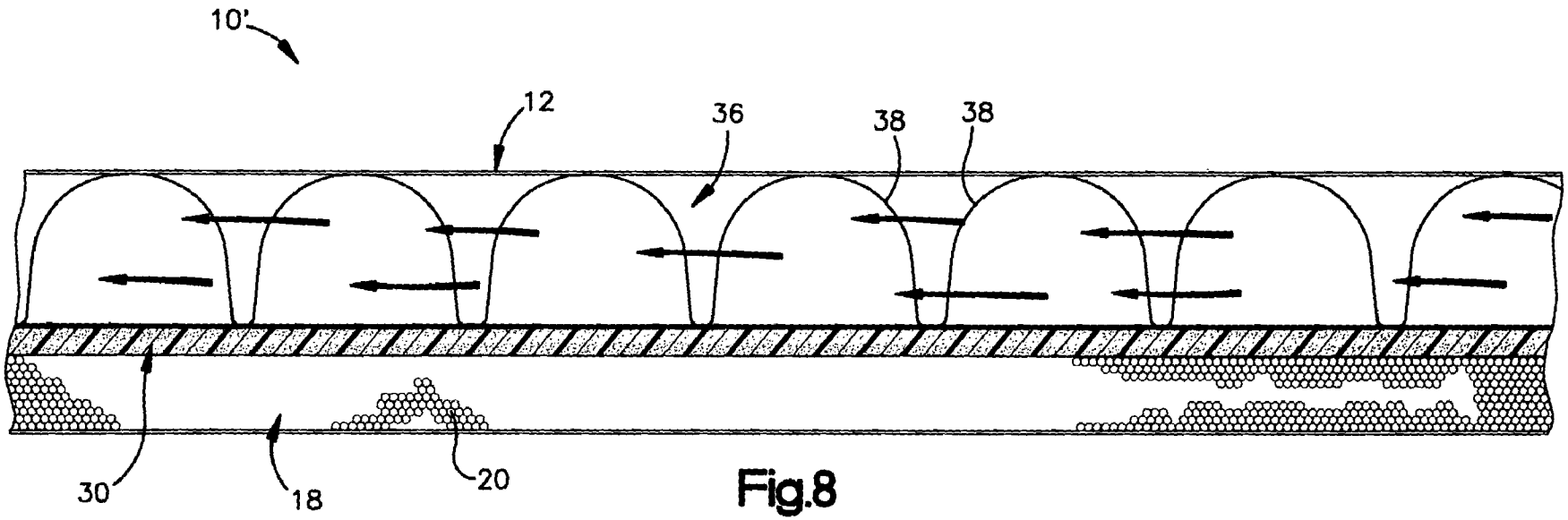
FIG. 8 is a sectional elevation view of a portion of an apparatus constructed in accordance with a second embodiment of the present invention.

FIG. 8 is a sectional elevation view of a portion of an apparatus 10' constructed in accordance with a second embodiment of the present invention. Structures of the apparatus 10' of FIG. 8 that are the same as or similar to those described with reference to the apparatus 10 of FIG. 1 are indicated in FIG. 8 with the same reference numbers as used with regard to FIG. 1.

The cover 12 of the apparatus 10' of FIG. 8 is formed from a gas impenetrable material. The apparatus 10' enables the interface temperature between the patient and the apparatus 10' to be regulated. The cover 12 includes spaced inlet and outlet ports (not shown). The inlet port is adapted to receive a conduit for blowing low-pressure air into the cover 12. The outlet port may be vented to atmosphere or may be connected to low-pressure vacuum source. The air blown into the cover 12 flows through gaps formed between adjacent air cells 38 in the air cell grid 36 and exits the cover 12 through the outlet port. FIG. 8 schematically illustrates the flow of air through the gaps formed between adjacent air cells 38 of the air cell grid 36 with arrows. The temperature of the air being blown into the cover 12 may be controlled so as to control the interface temperature between the patient and the apparatus 10'.

From the above description of the invention, those skilled in the art will perceive improvements, changes and modifications. For example, the air cell grid 36 may be regionalized so as to provide support for specific portions of the patient's body. For example, the air cell grid 36 may include a torso region, a lower limb region, etc. Such improvements, changes and modifications within the skill of the art are intended to be covered by the appended claims.

Having described the invention, we claim:

1. An apparatus for supporting a patient during a medical procedure, the apparatus comprising:

a bead bag including a valve means adapted to permit its subjection to a vacuum, that is filled with compressible beads, the bead bag forming a lower layer of the apparatus;

a layer of foam material located above the bead bag; and an air cell grid having a plurality of inflatable air cells, the air cell grid forming an upper layer of the apparatus and providing a soft surface upon which the patient lies, the bead bag, when subjected to a vacuum, becomes rigid for supporting the air cell grid against the patient for helping to maximize a surface area of contact between the patient and the apparatus.

2. The apparatus of claim 1 wherein each air cell of the air cell grid includes a base wall and an upper wall that moves away from the base wall when the air cell is inflated into an expanded condition, the upper wall, when the air cell is in the expanded condition, including surfaces that are angled relative to the base wall to provide radiologic translucency to the air cell grid.

3. The apparatus of claim 2 wherein the surfaces of the upper wall include a generally square base portion and a domed upper portion.

4. The apparatus of claim 2 further including an electrical switch for indicating a collapsed condition of an associated air cell of the air cell grid, the electrical switch including a first electrical contact that is located on the base wall of the associated air cell and a second electrical contact that is located on the upper wall of the associated air cell, the first and second electrical contacts coming into engagement with one another in response to the associated air cell moving into the collapsed condition.

5. The apparatus of claim 4 wherein the base wall and the upper wall of the associated air cell are formed from an electrically conductive material, the base wall forming the first electrical contact and the upper wall forming the second electrical contact, a layer of insulating material being interposed between the base wall and the upper wall and including cutouts for enabling engagement of the first and second electrical contacts.

6. The apparatus of claim 1 wherein the air cells of the air cell grid are divided into groups, each group including a plurality of air cells that are interconnected with one another by air channels.

7. The apparatus of claim 6 wherein each group has an associated valve, the valve being controllable for isolating the group of air cells from other groups of the air cell grid and for placing the group of air cells in fluid communication with the other groups.

8. The apparatus of claim 1 further including a cover for surrounding the bead bag, the layer of foam material, and the air cell grid, the cover being formed from a pliable elastic material.

9. The apparatus of claim 8 wherein the pliable elastic material of the cover is gas impenetrable, gaps located between adjacent air cells of the air cell grid forming conduits for air flow through the apparatus for enabling control of an interface temperature between the patient and the apparatus.

10. The apparatus of claim 1 wherein the layer of foam material provides a transition between the soft surface of the air cell grid and a rigid surface of the bead bag, when the bead bag is subjected to vacuum, the transition provided by the layer of foam material helping to reduce shear experienced by the patient.

* * * * *